US005411282A

United States Patent [19]

Shannon

[11] Patent Number: 5,411,282

[45] Date of Patent: May 2, 1995

[54] SYSTEM FOR GUIDING APPARATUS OVER A SURFACE

[76] Inventor: Walter Shannon, 12012 S. Compton Ave., Apt. 3-116, Los Angeles, Calif. 90059

[21] Appl. No.: 206,866

[22] Filed: Mar. 4, 1994

[51] Int. Cl.[6] ..... A63C 5/03

[52] U.S. Cl. ..... 280/606; 280/14.2; 280/16; 280/21.1

[58] Field of Search ..... 280/11.12, 606, 11.27, 280/14.2, 14.3, 16, 15, 17, 21.1, 22, 22.1, 98

[56] References Cited

U.S. PATENT DOCUMENTS

| | | | |
|---|---|---|---|
| 2,442,918 | 6/1948 | Caughrean | 280/15 |
| 2,592,116 | 4/1952 | Caughrean | 280/15 |
| 4,138,128 | 2/1979 | Criss | 280/16 X |
| 4,163,565 | 8/1979 | Weber | 280/16 |
| 4,175,759 | 11/1979 | Strunk | 280/16 |
| 4,194,753 | 3/1980 | Schrishuhn, Jr. | 280/13 |
| 4,221,394 | 9/1980 | Campbell | 280/14.2 |
| 4,652,007 | 3/1987 | Dennis | 280/618 |
| 4,725,069 | 2/1988 | Stampaccia et al. | 280/607 |
| 4,979,760 | 12/1990 | Derrah | 280/607 |
| 5,021,017 | 6/1991 | Ott | 441/70 |
| 5,028,068 | 7/1991 | Donovan | 280/618 |
| 5,249,816 | 10/1993 | Southworth | 280/14.2 |

*Primary Examiner*—Margaret A. Focarino
*Assistant Examiner*—Michael Mar
*Attorney, Agent, or Firm*—Christensen, O'Connor, Johnson & Kindness

[57] ABSTRACT

A system for guiding an apparatus including a forward and rear runner over a surface includes an elongate beam connecting the two runners and forward and rear strut assemblies for causing a deviation from a horizontal plane at the same time that a deviation from a longitudinal axis is introduced to the apparatus. The system allows the user to guide the device while at the same time providing the necessary tilting or weight shift needed to enhance the turning of the apparatus.

14 Claims, 5 Drawing Sheets

SYSTEM FOR GUIDING APPARATUS OVER A SURFACE

FIELD OF THE INVENTION

The present invention relates to a system for guiding an apparatus over a surface, such as snow or water, particularly an apparatus for sliding over snow.

BACKGROUND OF THE INVENTION

A snowboard is a long continuous surface platform made from a variety of materials designed to capture certain aspects of surfing on snow. When using a snowboard, there is a sensation of gliding over a surface and shifting one's body weight from one side of the board to another in order to execute a turn in either direction. In surfing, the execution and completion of a turn relies on the surface hull design (single concave, double concave), fins (single, double, triple), and overall body design (teardrop, asymmetrical). The execution of a turn with a snowboard is based on the flex and shape of the bow of the board and the ratio of the width of the bow to the width of the waist. The completion of the turn is based on a mixture of the flex and shape of the tail and the ratio of the width of the tail to the width of the waist. Ideally, a turn with a snowboard is initiated by applying pressure to the downhill foot and leaning down and into the side of the board one wishes to turn.

Skateboarding utilizes an articulating platform with wheels attached to trucks mounted to the underside of a platform that invariably is designed to appear as a surfboard. The execution and completion of a turn with a skateboard is accomplished by shifting weight from one side of the platform to the other and maintaining pressure slightly to the bow. The articulating wheels (front set turns one direction while the back set turns another) allow for completion of the turn. With a skateboard, the turns can be of varying radius and frequency.

Snowboarding and skateboarding attempt to capture aspects of surfing. Because of the snowboard's inherent design limitations it does not attain certain performance parameters in the hands of the average user. Specifically, short radius turns and high-frequency edge-to-edge turns are difficult and not attainable for the recreational user. In addition, the time to learn how to use a snowboard can be long and frustrating, causing some users to avoid attempts to learn. Control of the board is essential and time consuming to master. As noted above, control relies on shifting weight and movement of the uphill foot, from side to side, to assist in the turn cycle. It would be desirable to provide a system for guiding an apparatus on a surface, such as snow, that provides the sensation of surfing, i.e., leaning from side to side to carry out a turn, as well as edge-to-edge control that allows a user to achieve a sensation of cutting up and down the face of a wave while minimizing the loss of vertical feet. Such a device would desirably allow the first-time user to readily master the necessary skills which would further promote usage of the device.

SUMMARY OF THE INVENTION

The present invention provides a system for guiding an apparatus for sliding or riding on a surface. The system allows the user to readily master usage of the apparatus and provides the user with the ability to quickly learn how to turn the apparatus with relative ease. The system also provides the user with the sensation of leaning into the turn as the turn is being carried out.

One apparatus with which the system formed in accordance with the present invention can be used includes a forward runner and a rear runner, each having an upper substantially horizontal surface and an opposing substantially horizontal lower surface. The system for guiding the apparatus formed in accordance with the present invention includes a first shaft for mounting to the upper surface of the forward runner and a second shaft for mounting to the upper surface of the rear runner. An elongate beam having a forward coupling at one end connected to the first shaft for rotation in a horizontal plane about the first shaft and a rear coupling connected to the second shaft for rotation in a horizontal plane about the second shaft is also part of the system. The system also includes a rear strut assembly, including a rear strut having a runner end connected to the rear runner and a lever end connected to a rear lever and a forward strut assembly including a forward strut having a runner end connected to the forward runner and a lever end connected to a forward lever is also provided. The system also includes an intermediate strut that connects the forward lever to the rear lever.

The system of the present invention has widespread application since it allows the user to increase deviation from a horizontal plane with a deviation from a longitudinal axis of the apparatus. This operating principle of the present invention allows the user to "edge" the runners of the apparatus during turning.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The following description of the present invention is in the context of a system for guiding an apparatus over snow, similar to a snowboard. It should be understood that the system has equal applicability to other apparatuses that employ runners for sliding on surfaces other than snow, for example, water or ice. As noted above, the system allows the user to increase deviation of the runners from a horizontal plane at the same time that a deviation from the longitudinal axis of the apparatus occurs. Stated another way, the user can tilt or edge the runners at the same time that a turn is being implemented. This deviation in accordance with the present invention is achieved by the application of pressure, which can be provided manually or by mechanically-assisted means such as hydraulics or pneumatics.

Figure 1:
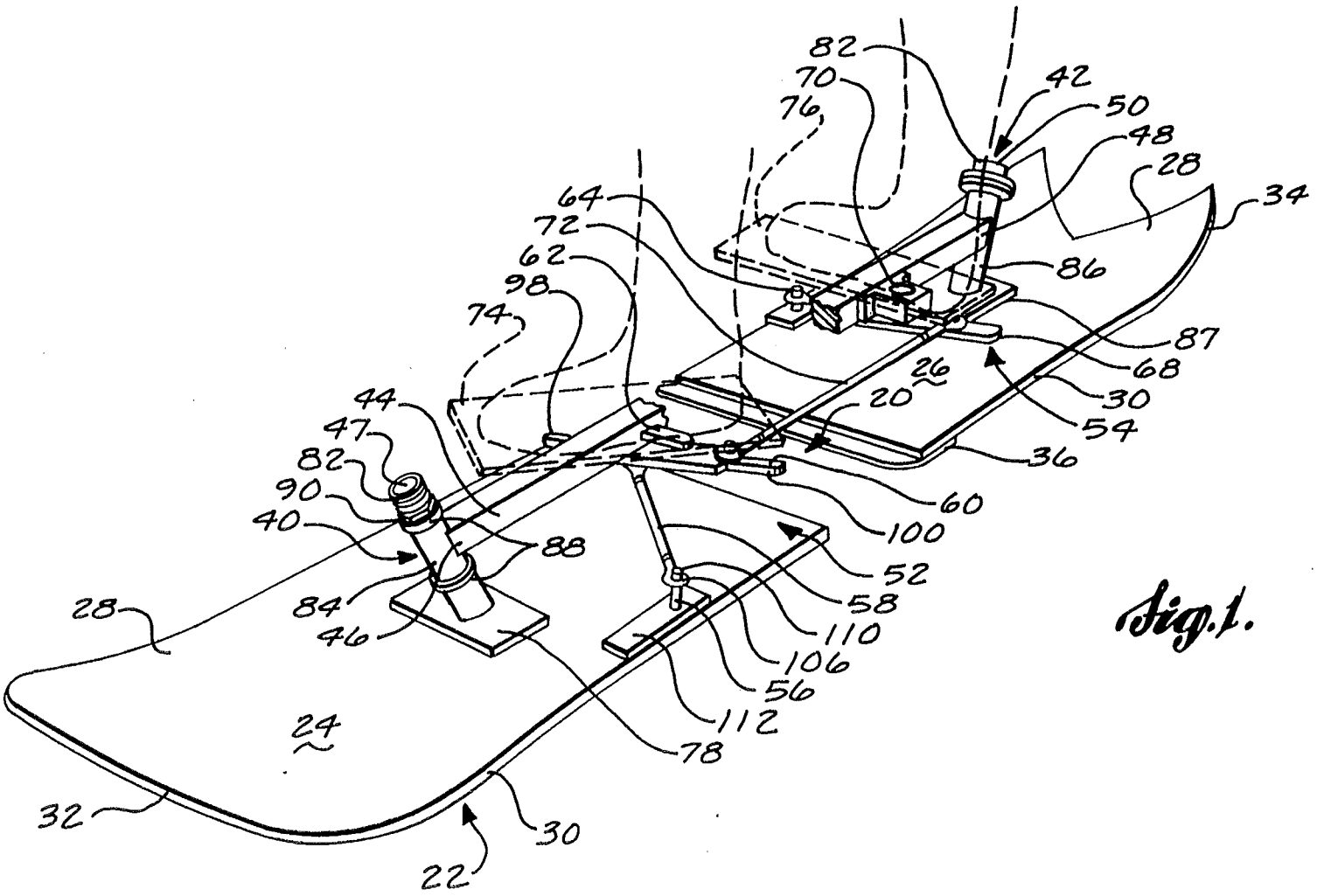
FIG. 1 is a perspective view of a system for guiding an apparatus over snow formed in accordance with the present invention.
Figure 2:
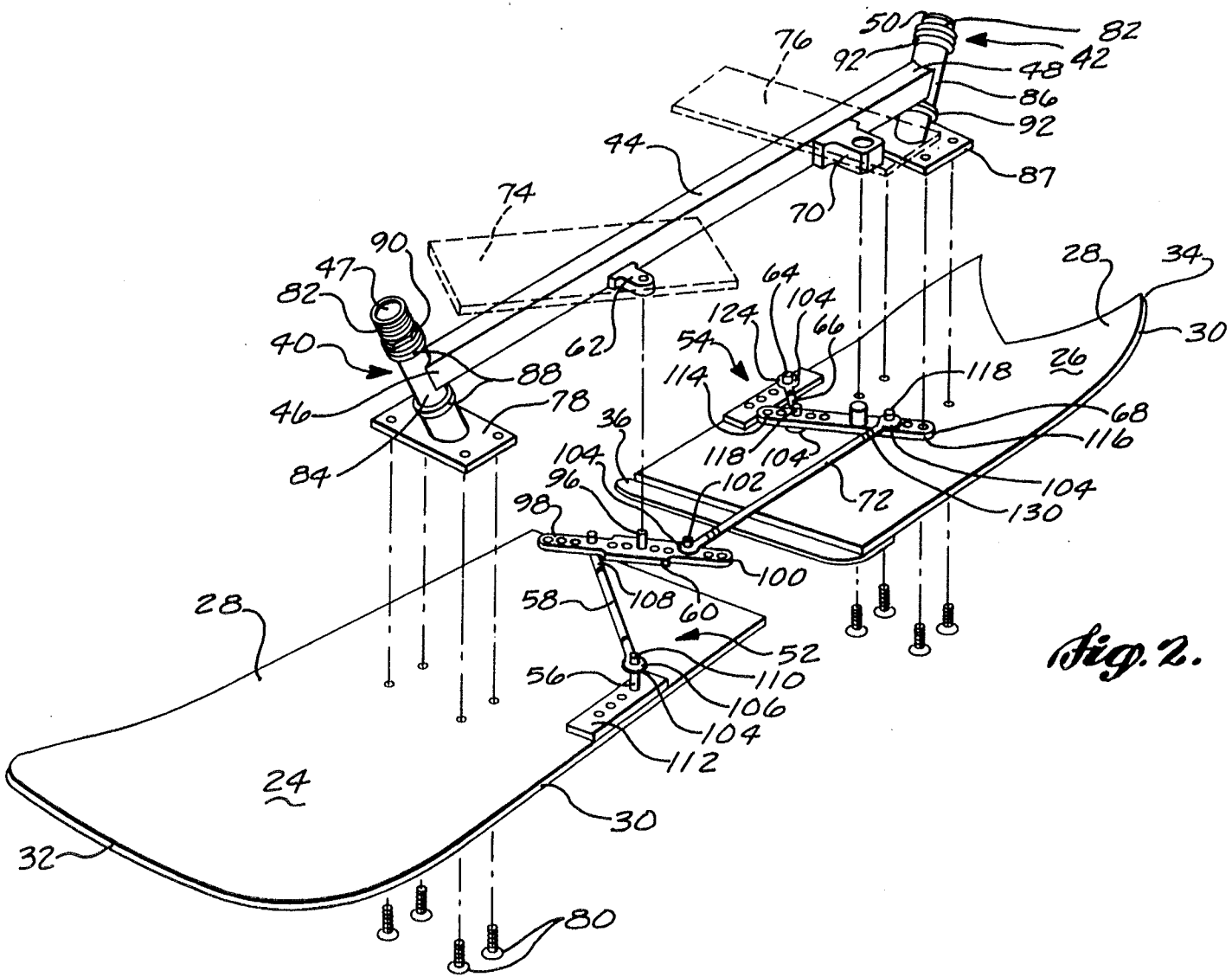
FIG. 2 is an exploded view of the system of FIG. 1.
Figure 3:
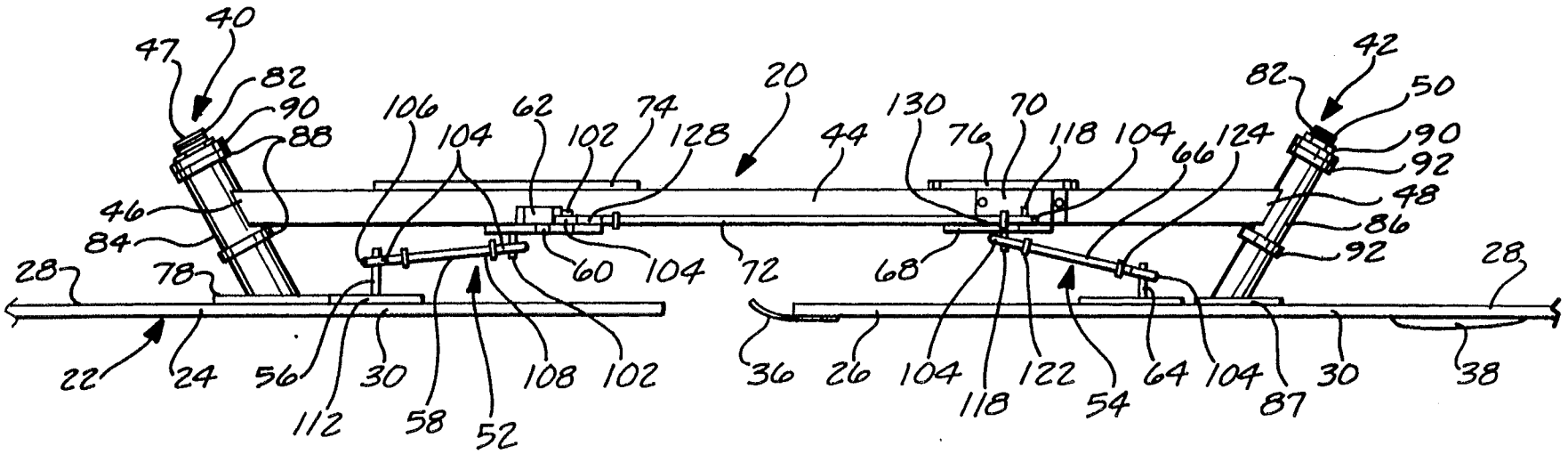
FIG. 3 is a side elevation view of the system of FIG. 1.

Referring to FIGS. 1, 2 and 3, system 20 formed in accordance with the present invention is associated with a two-piece ski apparatus for sliding over snow, similar to a snowboard. Apparatus 22 for sliding over snow includes forward runner 24 and rear runner 26, each having an upper surface 28 and an opposing lower surface 30. Forward runner 24 at its front end includes turned-up tip 32. Rear runner 26 at its rear end includes a turned-up rear 34 and the front end of rear runner 26 is also provided with a turned-up portion 36 to prevent it from digging into the surface over which it is sliding. The rear end of the underside of rear runner 26 is provided with fin(s) (38 in FIG. 3) for stability.

In the illustrated embodiment, system 20 formed in accordance with the present invention includes forward shaft assembly 40 mounted on upper surface 28 of forward runner 24 and rear shaft assembly 42 mounted on upper surface 28 of rear runner 26. Forward shaft assembly 40 and rear shaft assembly 42 are mounted on respective upper surfaces 28 of forward runner 24 and rear runner 26 about halfway along the length of the respective runners and are centered along the centerline thereof. An elongate beam 44 traverses the distance between forward shaft assembly 40 and rear shaft assembly 42. Elongate beam 44 includes forward end 46 that is coupled to forward shaft 47 for rotation in a horizontal plane about forward shaft assembly 40 and rear end 48 that is coupled to rear shaft 50 for rotation in a horizontal plane about rear shaft assembly 42. The illustrated embodiment of the system formed in accordance with the present invention also includes forward strut assembly 52 mounted below elongate beam 44 between forward shaft assembly 40 and the rear end of forward runner 24. A rear strut assembly 54 is mounted below elongate beam 44 between rear shaft assembly 42 and forward end 36 of rear runner 26. Forward strut assembly 52 includes forward pin 56, forward strut 58, forward lever 60, and forward bearing 62 that are described below in more detail. Rear strut assembly 54 includes rear pin 64, rear strut 66, rear lever 68, and rear bearing 70 that are described below in more detail. Forward strut assembly 52 and rear strut assembly 54 are connected by intermediate strut 72 that spans the space between the two. The system formed in accordance with the present invention also includes forward platform 74 mounted above elongate beam 44 and forward strut assembly 52 and rear platform 76 mounted above elongate beam 44 and rear strut assembly 54. Forward platform 74 and rear platform 76 are shown in phantom lines in FIGS. 1 and 2 for purposes of clarity.

Forward shaft assembly 40 includes rectangular base 78 that is mounted onto upper surface 28 of forward runner 24 by conventional means such as bolts 80 or rivets. Extending upward and in a forward direction is tubular forward shaft 47. The longitudinal axis of forward shaft 47 forms an angle of about 45° to about 85° with upper surface 28 of forward runner 24. When the angle formed between longitudinal axis of forward shaft 47 and upper surface 28 is near the larger end of the range noted above, the amount that forward runner 24 deviates from a horizontal plane caused by a given deviation from the longitudinal axis of the apparatus is less compared to when the angle between forward shaft 47 and upper surface 28 of forward runner 24 is near the low end of the noted range. Rear shaft 50 is substantially identical to forward shaft 47; however, rear shaft 50 is angled rearward with its longitudinal axis forming an angle of about 45° to about 85° with upper surface 28 of rear runner 26. Both forward shaft 47 and rear shaft 50 include a threaded end 82 opposite rectangular base 78. Intermediate threaded ends 82 and rectangular base 78 is a section having an outer diameter greater than the outer diameter of the threaded end. The location where the outer diameter of shafts 47 and 50 increases provides a shoulder for supporting forward coupling 84 and rear coupling 86 as described below in more detail.

Elongate beam 44 includes forward coupling 84 at its forward end and rear coupling 86 at its rear end. Forward coupling 84 includes a tubular element angled forward and having an inner diameter sized to slide over the portion of forward shaft 47 with the smaller outer diameter. The inner diameter of forward coupling 84 is slightly larger than the outer diameter of forward shaft 47 above the shoulder; however, the inner diameter of forward coupling 84 is less than the outer diameter of the shoulder. Accordingly, forward coupling 84 slides onto the upper end of forward shaft 47 and slides down to the supporting shoulder. Forward coupling 84 includes a longitudinal axis that forms an angle with the underside of elongate beam 44 that is substantially identical to the angle formed between forward shaft 47 and upper surface 28 of forward runner 24. Forward coupling 84 has an upper end and a lower end that include bearings 88 for providing smooth rotation of forward coupling 84 in a substantially horizontal plane around forward shaft 47. Forward coupling 84 is secured to forward shaft 40 by threading a nut 90 onto threaded end 82 of forward shaft 47 and tightening it against the upper end of forward coupling 84.

Rear coupling 86 is substantially identical to forward coupling 84 and includes a rectangular base 87 and a tubular element having bearings 92 on both ends; however, rear coupling is angled to the rear of rear runner 26. Like forward coupling 84, rear coupling 86 includes a longitudinal axis that forms an angle with the underside of elongate beam 44 that is substantially identical to the angle formed by the longitudinal axis of rear shaft 50 and upper surface 28 of rear runner 26. Rear coupling 86 rests on the shoulder of rear shaft 50 and is secured thereto by a nut 94 threaded onto threaded end 82 of rear shaft 50.

When forward coupling 84 is secured to forward shaft 47 and rear coupling 86 is secured to rear shaft 50, elongate beam 44 is supported between forward shaft 47 and rear shaft 50 for rotation around forward shaft 47 and rear shaft 50 in a substantially horizontal plane. Elongate beam 44 in the illustrated embodiment is a substantially square element having a length several inches longer than the distance between rectangular plates 78 and 87 for forward shaft 47 and rear shaft 50. In this manner, elongate beam 40 maintains the spacing between forward runner 24 and rear runner 26.

The right side of elongate beam 44 includes forward beating 62 and rear bearing 70. Forward bearing 62 is mounted substantially directly beneath forward platform 74 and rear bearing 70 is mounted substantially directly below rear platform 76. Forward bearing 62 receives pin 96 that mounts forward lever 60 to elongate beam 44 for pivotal rotation in a horizontal plane. Forward lever 60 is a thin, elongate, substantially rectangular plate that includes a left end 98 and an opposing right end 100. Left end 98 and right end 100 of forward lever 60 include balls 102 for receiving open sockets 104 on forward strut 58 and intermediate strut 72 described below in more detail. Forward lever 60 includes pin 96 at a point centered between left end 98 and right end 100. Forward lever 60 includes a plurality of bores passing through its body. The bores are spaced apart so that the spacing between balls 102 and pin 96 that are carried in the bores can be varied.

Forward strut assembly 52 further includes forward strut 58 that includes pin end 106 and an opposing lever end 108. Lever end 108 includes an open socket 104 connection for receiving and securing ball 102 on forward lever 60. Pin end 106 of forward strut 58 includes an open socket 104 connection for securing to ball 110 of forward pin plate 112 described below. Extending from open socket 104 connections of pin end 106 and opposing lever end 108 is a threaded member that is received by matching threads in the body of forward strut 58. Adjustment of the length of forward strut 58 can be achieved by threading respective open socket 104 connections farther into or farther out of forward strut 58.

Pin end 106 of forward strut 58 is affixed to forward pin 56 carried by pin plate 112 that is attached to upper surface 28 of forward runner 24 along a right edge. Pin plate 112 is a flat, elongate, substantially rectangular plate that includes a plurality of bores passing therethrough. In the illustrated embodiment, seated in one of the bores of forward pin plate 112 is forward pin 56. Pin plate 112 is fastened to upper surface 28 of forward runner 24 by conventional means such as bolts or rivets. Forward pin plate 112 is mounted intermediate forward shaft 47 and forward strut assembly 52.

Rear strut assembly 54 is similar to forward strut assembly 52 and includes rear lever 68 carried by rear bearing 70 for rotation in a substantially horizontal plane below elongate beam 44. Rear pin 64 of rear lever 68 is attached to rear platform 76 through bearing 70. Accordingly, rotation of rear platform 76 in a horizontal plane results in rotation of rear lever 68 in a horizontal plane. Rear lever 68 is a thin, elongate, substantially rectangular plate that includes a left end 114 and an opposing right end 116 that each include a ball 118 for receiving open socket 104 connections of intermediate strut 72 and rear strut 66 as described below in more detail. Rear lever 68 is connected to rear bearing 70 at a point centered between left end 114 and right end 116. Rear strut assembly 54 also includes rear strut 66 having a lever end 122 and an opposing pin end 124 that each include open socket connections 104 for securing to rear pin 64 mounted at left edge of rear runner 26 and ball 104 mounted on left end 114 of rear lever 68. As with forward strut 60, extending from open socket 104 connections at left end 114 and right end 116 of rear strut 68 are threaded members for threading into or out of body of rear strut 68. Threading open socket 104 connections into or out of the body of rear strut 68 provides a means for adjusting the length of rear strut 68. In the illustrated embodiment, rear pin 64 is mounted to rear pin plate 126 that is secured to upper surface 28 of rear runner 26 using conventional bolts or rivets. Rear pin plate 126 is mounted along the left edge of rear runner 26 at a point intermediate rear shaft 50 and rear strut assembly 54.

In the illustrated embodiment of a system formed in accordance with the present invention also includes intermediate strut 72 extending between right end 100 of forward lever 60 and right end 116 of rear lever 68. Intermediate strut 72 is a tubular element that has a forward end 128 and a rear end 130. Rear end 130 and forward end 128 include open socket 104 connections having threaded members extending therefrom. The threaded members are received by the body of intermediate strut 72 so that threading open socket 104 connections into or out of body changes the length of intermediate strut 72. Open socket 104 connection on forward end 128 of intermediate strut 72 is secured to ball 120 on right end 100 of forward lever 60 and open socket 104 connection at rear end 130 of intermediate strut 72 is secured to ball 118 on the right end 116 of rear lever 68. Such ball and open socket configuration allows the respective struts to pivot and rotate in all directions around the respective balls.

Figure 4:
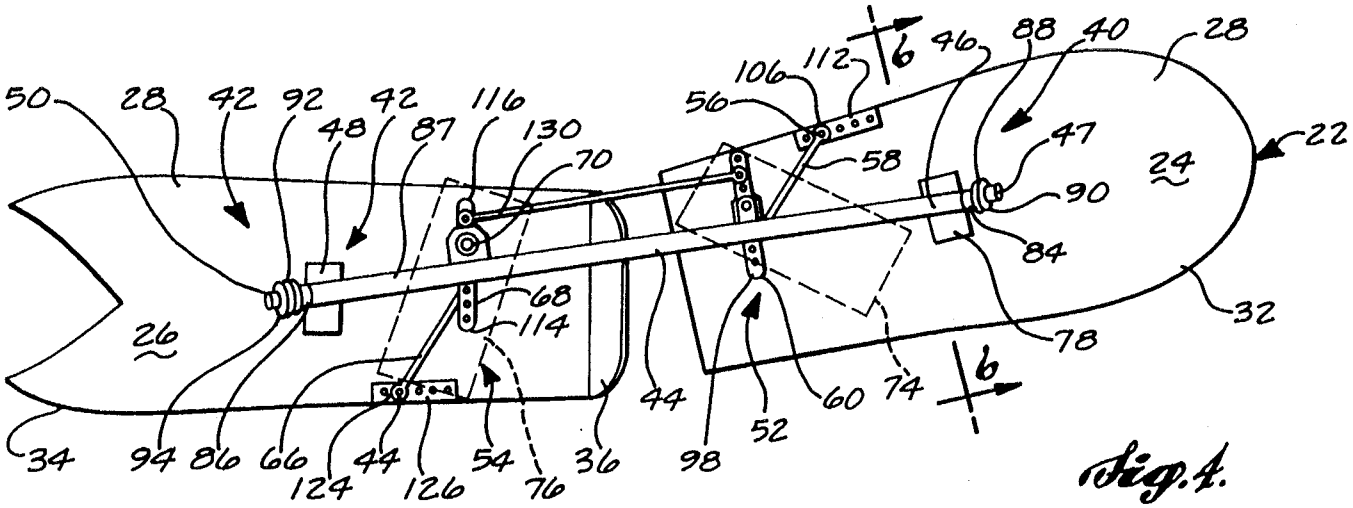
FIG. 4 is a top plan view of the system of FIG. 1 with the components positioned for a left turn.
Figure 5:
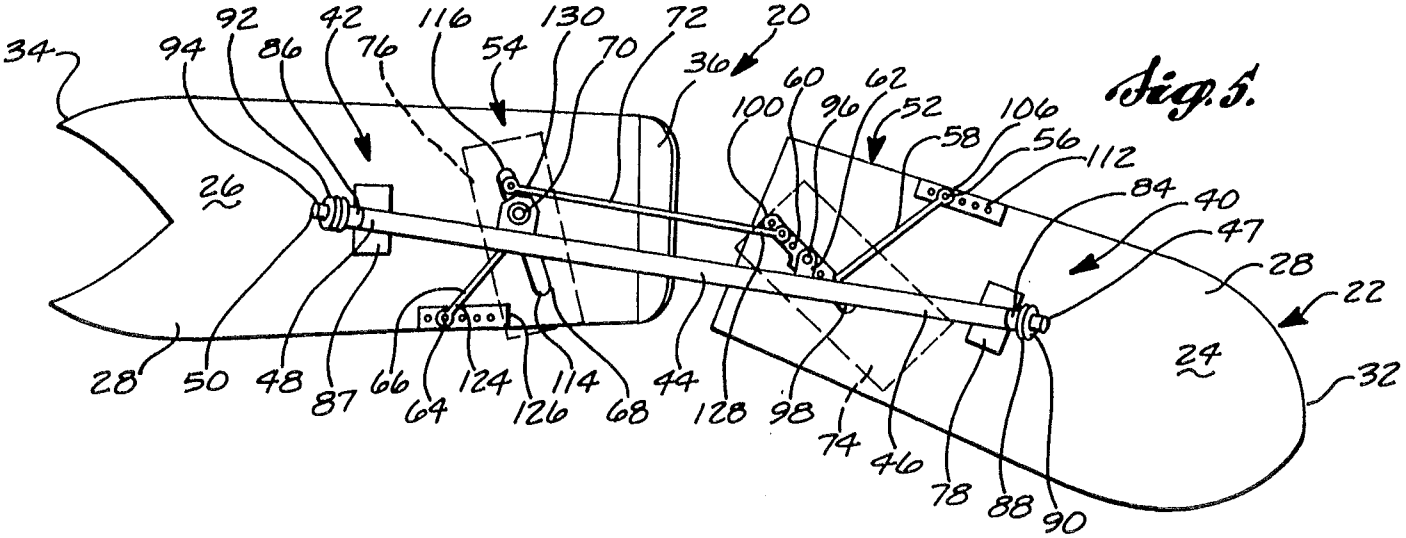
FIG. 5 is a top plan view of the system of FIG. 1 showing the components in a position for a right turn.

Referring to FIGS. 4 and 5, rotation of rear platform 76 clockwise causes rear lever 68 to also rotate clockwise around bearing 70. This clockwise rotation pushes on rear strut 68 to the left and pushes intermediate strut 72 forward. Pushing of rear strut 68 to the left causes rear runner 26 to rotate clockwise around rear shaft 50. At the same time, because of the particular angle provided to rear shaft 50, rear runner 26 is caused to edge its left edge into the underlying surface. The forward displacement of intermediate strut 72 causes forward lever 60 to pivot in a clockwise direction which results in forward strut 58 being pulled rearward and to the left. This results in forward runner 24 pivoting about first shaft 47 to the left. Again, the angling of first shaft 47 causes front runner 24 to tilt to the left, allowing the left edge to dig into the underlying surface.

If rear platform 76 is rotated counterclockwise, the effect is to cause the front runner 24 and rear runner 26 to turn to the right and the right edge to dig into the underlying surface. Counterclockwise rotation of rear platform 76 causes rear lever 68 to also rotate counterclockwise around bearing 70. This counterclockwise rotation pulls on rear strut 68 to the left and pulls intermediate strut 72 rearward. Pulling of rear strut 68 to the left causes rear runner 26 to rotate counterclockwise around rear shaft 50. At the same time, because of the particular angle provided to rear shaft 50, rear runner 26 is caused to edge its right edge into the underlying surface. The rearward displacement of intermediate strut 72 causes forward lever 60 to pivot in a counterclockwise direction that results in forward strut 58 being pushed forward and to the left. This results in forward runner 24 pivoting about first shaft 47 to the right. Again, the angling of first shaft 47 causes front runner 24 to tilt to the right, allowing right edge to dig into the underlying surface.

Figure 6:
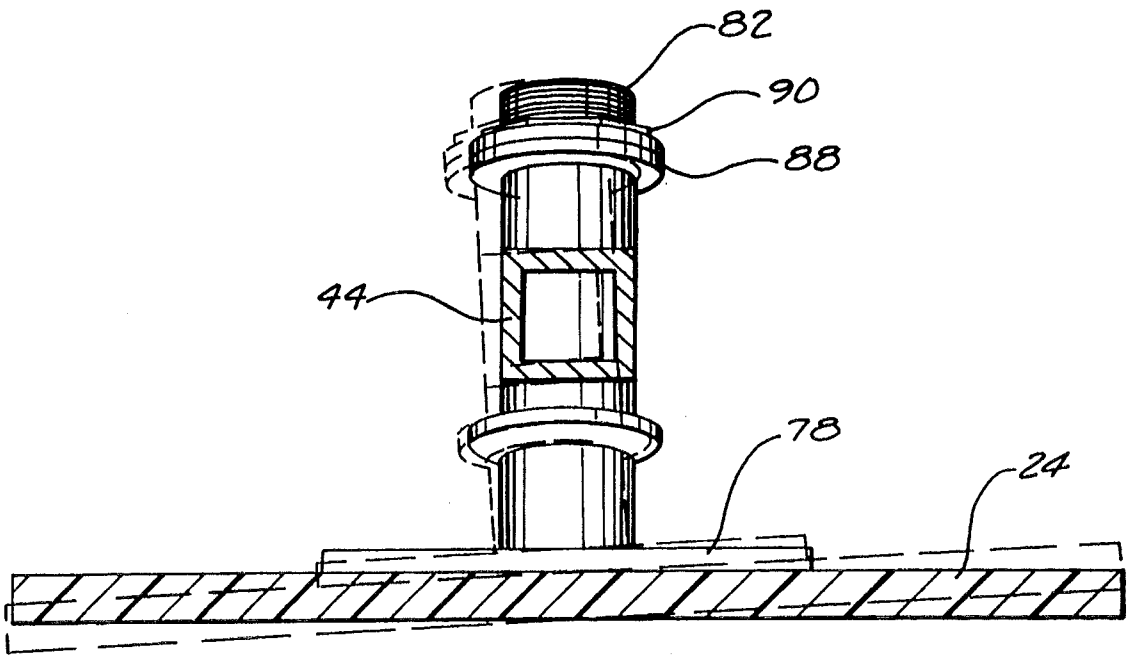
FIG. 6 is a vertical cross section along line 6—6 in FIG. 4.

The principle of the angled shafts causing the front runner and the rear runner to edge into the direction of the turn is illustrated in FIG. 6. The dotted lines correspond to the position of the front runner when a turn is initiated to the left.

It should be understood that while the present invention has been described above in the context of a specific embodiment, other lever designs and strut designs may be employed that implement the principles of the present invention. Those principles include increasing deviation from a horizontal axis of an apparatus for moving over a surface such as snow or water with a deviation from the longitudinal axis of the apparatus.

The elements of the system formed in accordance with the present invention can be manufactured from any strong lightweight materials, such as aluminum alloys or other metals. Likewise, other configurations of the ball and socket and strut assemblies may be employed within the context of the present invention. It should be understood that while the illustrated embodiment of the present invention illustrates the deviation from the horizontal axis and the longitudinal axis being caused by mechanical forces applied to the rear surface platform, other types of systems including hydraulics and pneumatics can be used to manipulate the system formed in accordance with the present invention. For example, rather than having the strut assemblies being manipulated by a user's feet, a steering assembly for hand control can be provided.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A system for guiding an apparatus for sliding on a surface, the apparatus including a forward runner and a rear runner, the forward runner and the rear runner each having an upper substantially horizontal surface and an opposing substantially horizontal lower surface; the system comprising:

a first shaft for mounting to the upper surface of the forward runner;

a second shaft for mounting to the upper surface of the rear runner;

an elongate beam having a forward end and a rear end, the forward end including a forward coupling for connecting the forward end to the first shaft for rotation in a horizontal plane about the first shaft, the rear end including a rear coupling for connecting the rear end to the second shaft for rotation in a horizontal plane about the second shaft;

a rear strut assembly including a rear strut having a runner end and a lever end, the runner end of the rear strut connected to the rear runner and the lever end of the rear strut connected to a rear lever, the rear lever being pivotally connected to the elongate beam;

a forward strut assembly including a forward strut having a runner end and a lever end, the runner end of the forward strut connected to the forward runner and the lever end of the forward strut connected to a forward lever, the forward lever being pivotally connected to the elongate beam; and an intermediate strut connecting the forward lever to the rear lever.

2. The system of claim 1, wherein the first shaft is canted forward and the second shaft is canted rearward.

3. The system of claim 2, wherein the first shaft is canted at an angle ranging from about 45° to about 85° from the upper surface of the forward runner.

4. The system of claim 2, wherein the second shaft is canted at an angle ranging from about 45° to about 85° from the upper surface of the rear runner.

5. The system of claim 1, wherein the first and second shafts each include cylindrical tubes that have substantially transverse mounting plates for securing to the upper surface of the forward and rear runners.

6. A system of claim 5, wherein the forward and rear couplings each include a cylindrical housing having an upper end and a lower end, the upper end and lower end including bearings.

7. The system of claim 1, wherein the elongate beam further comprises a bearing for pivotally connecting the lever to the elongate beam.

8. The system of claim 7, wherein the rear lever is connected to a pivotable rear support platform located above the elongate beam and connected to the lever through the bearing.

9. The system of claim 8, wherein the rear strut assembly further comprises a rear pin mounted to the upper surface of the rear runner and pivotally connected to the runner end of the rear strut.

10. The system of claim 9, wherein the rear pin is mounted along an outside edge of the rear runner.

11. The system of claim 1, wherein a forward support platform is mounted above the beam adjacent the forward strut assembly.

12. The system of claim 1, wherein the forward strut assembly further comprises a forward pin mounted to the upper surface of the forward runner and pivotally connected to the runner end of the forward strut.

13. The system of claim 12, wherein the forward pin is mounted along an outside edge of the forward runner.

14. The system of claim 1, wherein displacement of the intermediate strut in a forward direction results in displacement of the forward strut and the rear strut in a rearward direction.

* * * * *